US006543250B1

(12) United States Patent
Mills et al.

(10) Patent No.: US 6,543,250 B1
(45) Date of Patent: Apr. 8, 2003

(54) INSTALLATION TEMPLATE FOR A MOBILE REFRIGERATOR

(75) Inventors: Christopher J. Mills, Oxford, MS (US); Patrick N. McConnell, Goshen, IN (US); Christine Holland, LaGrange, IN (US)

(73) Assignee: Dometic Corporation, Elkhart, IN (US)

( * ) Notice: Subject to any disclaimer, the term of this patent is extended or adjusted under 35 U.S.C. 154(b) by 0 days.

(21) Appl. No.: 09/994,963

(22) Filed: Nov. 27, 2001

(51) Int. Cl.[7] ..... F25D 17/06; F24F 13/00

(52) U.S. Cl. ..... 62/428; 62/440; 62/454; 454/237

(58) Field of Search ..... 62/428, 244, 452, 62/454, 455, 456, 440, 476; 454/237

(56) References Cited

U.S. PATENT DOCUMENTS

| | | | | |
|---|---|---|---|---|
| 2,603,548 | A | | 7/1952 | Harbison |
| 3,818,171 | A | | 6/1974 | Miller et al. |
| 3,912,349 | A | | 10/1975 | Hoetker |
| 4,297,850 | A | | 11/1981 | Reed |
| 4,522,040 | A | | 6/1985 | Ochiai et al. |
| 4,699,207 | A | | 10/1987 | Hanemaayer |
| 4,714,304 | A | | 12/1987 | Sisk et al. |
| 4,932,224 | A | | 6/1990 | Katterhenry et al. |
| 4,970,874 | A | | 11/1990 | Solak et al. |
| 5,083,443 | A | | 1/1992 | von Blanquet |
| D334,201 | S | | 3/1993 | Purkapile |
| 5,291,749 | A | | 3/1994 | Schulak |
| D379,467 | S | | 5/1997 | Martin et al. |
| 5,744,213 | A | | 4/1998 | Nelson |
| 5,782,105 | A | | 7/1998 | Stork |
| 5,946,929 | A | | 9/1999 | Selina et al. |
| 6,076,363 | A | | 7/2000 | Morton |
| 6,367,280 | B1 | * | 4/2002 | Funabasama et al. ..... 62/454 |
| 6,461,234 | B1 | * | 10/2002 | Kretzer ..... 454/237 |

* cited by examiner

*Primary Examiner*—Chen-Wen Jiang
(74) *Attorney, Agent, or Firm*—Pearne & Gordon LLP

(57) ABSTRACT

A refrigerator cabinet having a selected height and width used in a recreational vehicle, the improvement comprises an installation template permanently installed as a ventilation frame. The installation template produces manufacturer specified ventilation requirements for the ventilating refrigerating apparatus provided on the refrigerator and located on the refrigerator within the refrigerator cabinet. The installation template includes a top, bottom and side flanges, the dimensions of each of the flanges being selected according to the height, width and ventilation requirements of said refrigerator. Ambient air flow through the installation template may be used to produce the specified ventilation requirements for the refrigerating apparatus. In addition, an air movement device for providing air flow through the installation template for ventilation around the refrigerating apparatus may be used, such as a fan, reducing the amount of ventilation area required for the installation template.

17 Claims, 5 Drawing Sheets

INSTALLATION TEMPLATE FOR A MOBILE REFRIGERATOR

BACKGROUND OF THE INVENTION

This invention relates generally to a refrigerator for a recreational vehicle, hereinafter referred to as an "RV", where living space is limited. Such a refrigerator typically includes a refrigerator cabinet and a frame that positions the refrigerator cabinet in the interior of the RV. The typical frame is a box-type structure made from a solid strip of material that both functionally and aesthetically positions the refrigerator in its proper stead. The solid nature of the typical frame does not allow for adequate ventilation of the refrigerator once installed.

SUMMARY OF THE INVENTION

An aspect of the present invention is to provide a refrigerator and vent assembly to be installed in a vehicle space. The assembly includes a refrigerator with refrigerating apparatus to be cooled disposed on a cabinet. The assembly also includes an installation template permanently installed on the cabinet as a ventilation frame. The installation template includes a top, bottom and side flanges, and at least one of the flanges having ventilation openings. The dimensions of each of the flanges and openings is selected to ensure an air flow space according to specified ventilation requirements for the refrigerating apparatus.

Another aspect of the present invention is to provide an air movement device with the refrigerator and vent assembly for providing forced air flow through the space. The device providing the specified ventilation requirements for the refrigerating apparatus.

Another aspect of the present invention is to provide the use of a retention bracket attached to the RV floor and installed before the installation template to position a rear wall of the refrigerator cabinet.

Further aspects, features and advantages of the invention will become apparent from a consideration of the following description and the appended claims when taken in connection with the accompanying drawings.

DESCRIPTION OF THE INVENTION

The present invention provides a permanent frame having adequate free air space for both inlet and exhaust air to circular and properly vent the refrigerating apparatus. The frame is designed to be a refrigeration cabinet installation template that is installed integral to the refrigerator and has a number of slots, louvers, or other holes to allow for the passage of cooling air to the refrigerator's refrigerating apparatus. The frame also serves the purpose of forcing the refrigerator installer to provide a permanent enclosure large enough to produce adequate air circulation space around the refrigerator's sides, either with or without the assistance of a fan located within the enclosure area.

During the installation of a refrigeration unit in an RV, the RV manufactures or after-market company, installs the refrigeration unit in any location that it sees fit in the interior design, typically, failing to follow the refrigerator manufacturer recommended installation requirements and consequently, the ventilation requirements. Often, the refrigeration cabinet is one of the last items to be installed into an RV interior and is fitted in whatever amount of space may be remaining after all other interior items are installed. This space usually does not include an enclosure area large enough to allow adequate air circulation to the refrigerator. Inadequate airventilation causes the refrigerator to overheat and break down, resulting in refrigeration units being returned to the manufacturer with accompanying unexpected warranty repair costs.

Figure 1:
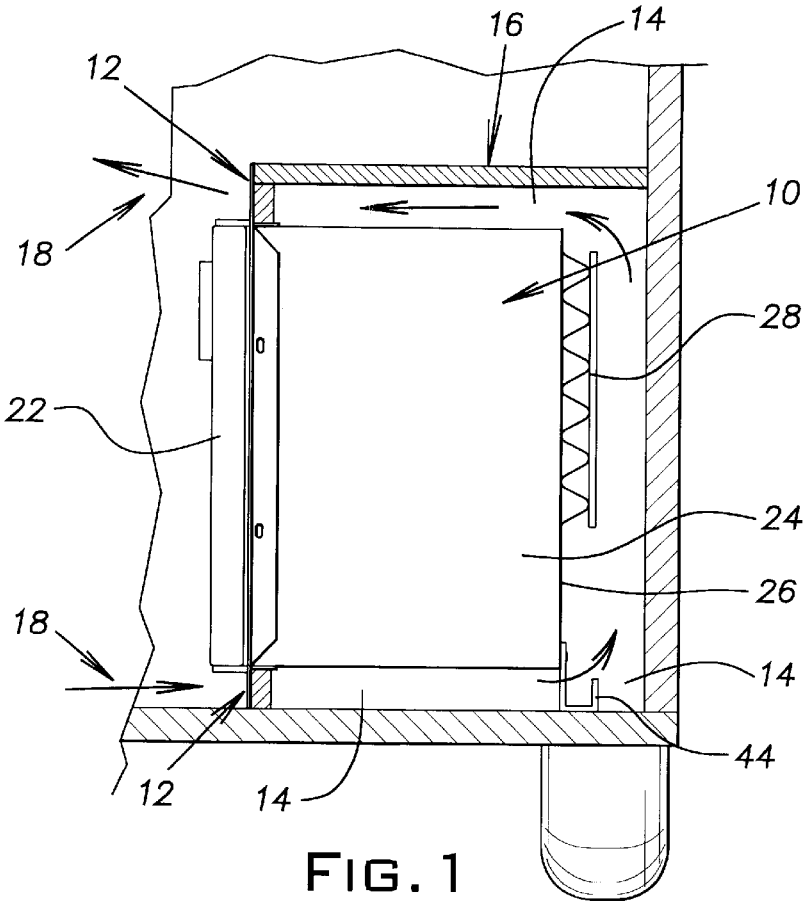
FIG. 1 is a cut-away side view of an RV refrigerator of this invention installed in an RV.

With reference to the FIG. 1, a refrigerator cabinet 10 is positioned in a recreational vehicle (RV) such that the cabinet 10 is spaced a certain distance from the RV walls. The refrigerator cabinet 10 is provided with an installation template 12 and the combination may be permanently installed in a space selected for use as a ventilation enclosure 16. The installation template 12 includes a box-type structure having mounting flanges and ventilation openings 20 (FIG. 2) in the box-type structure on at least two different sides of the installation template 12. The installation template 12 attached to the refrigerator cabinet 10 may be permanently installed as part of a ventilation enclosure 16 used to ventilate the refrigerator cabinet 10.

A retention bracket 44 may be installed onto the floor of the RV in conjunction with the installation template 12. The retention bracket 44 may be a generally, for example, a U-shaped bracket that may be attached to the floor and that positions the rear wall 26 of the cabinet of the refrigerator cabinet 10 in the enclosure space 14. The rear wall 26 of cabinet 10 sits up against a leg of the retention bracket 44 as shown in FIG. 1. The retention bracket 44 allows refrigerating apparatus 28, described hereinafter, adequate ventilation space and airflow path 18 a minimum path to circulate around the cabinet 10.

The retention bracket 44 may be constructed in many forms all of which would serve the same purpose as the form described in the present invention. In one form, the retention bracket could include a L-shaped bracket attached to a wall of the RV. In another form, the retention bracket could be permanently attached to the rearwall of the refrigeration cabinet and slide in with the cabinet. Any form of retention bracket 44 that would allow for adequate ventilation space and airflow path 18 a minimum path to circulate around the cabinet 10 would be included under the scope of the present invention.

The installation template 12 may include a top flange 30 (for example, FIG. 3), a bottom flange 32 and side flanges 34. Alternate template designs such as a design where the template is placed inside the enclosure space, as for example, in the center or at the rear of the enclosure space would be included under the scope of the present invention.

The dimensions of each of the flanges are selected according to the height, width and ventilation requirements of a particular refrigerator cabinet 10 that is installed. The installation template 12 ensures that the refrigerator cabinet 10 is installed to provide adequate ventilation air 18 (FIG. 1) into a built-in enclosure space 14 as specified by the refrigerator cabinet manufacturer for reliable operation of the refrigerator located within the refrigerator cabinet 10.

As shown in FIG. 1, refrigerator cabinet 10 comprises a generally block-shaped structure having a front side door 22, side walls 24 and a rear wall 26. The refrigerator located within the refrigerator cabinet 10 is of the absorption-type which uses a heat source to effect refrigeration. An absorption refrigerator has a heat generator which heats a solution of a refrigerant and an absorbent. The heat releases the refrigerant from the absorbent to form a high pressure refrigerant vapor. The refrigerant vapor is condensed in a cooling condenser. Low pressure solution from the heat generator is sprayed on the refrigerant vapor in an absorber to absorb the vapor. The absorption causes the pressure of the vapor to be reduced, thereby causing the evaporation in an evaporator between the condenser and the absorber. The refrigerant vapor expands in the evaporator which causes a temperature drop in the refrigerant which is used to cool the interior of the refrigerator located within refrigerator cabinet 10. Refrigeration apparatus of the absorption type is commonly used and has been known for a long time. This well known refrigeration apparatus is included on the refrigerator cabinet 10 and is indicated generally as 28 in FIG. 1, and can be mounted on the back wall 26 of the refrigerator cabinet 10.

Figure 2:
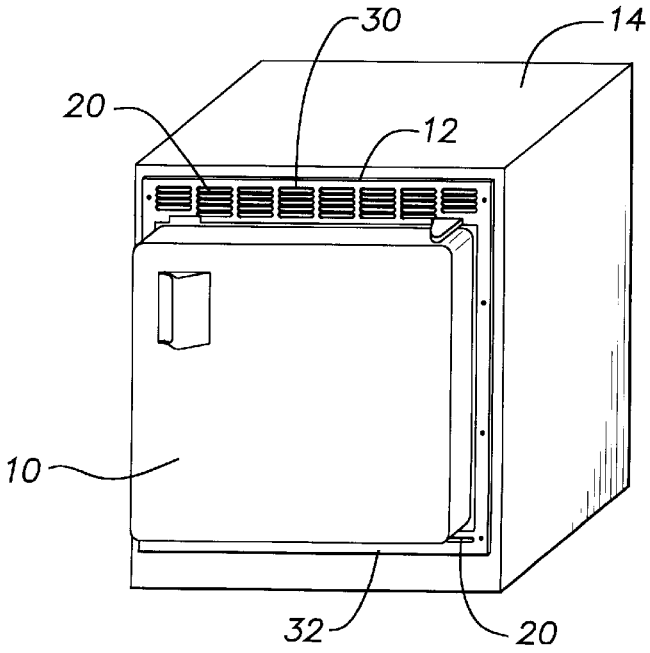
FIG. 2 is an exploded view of the RV refrigerator and the installation template as provided for in this invention.
Figure 8:
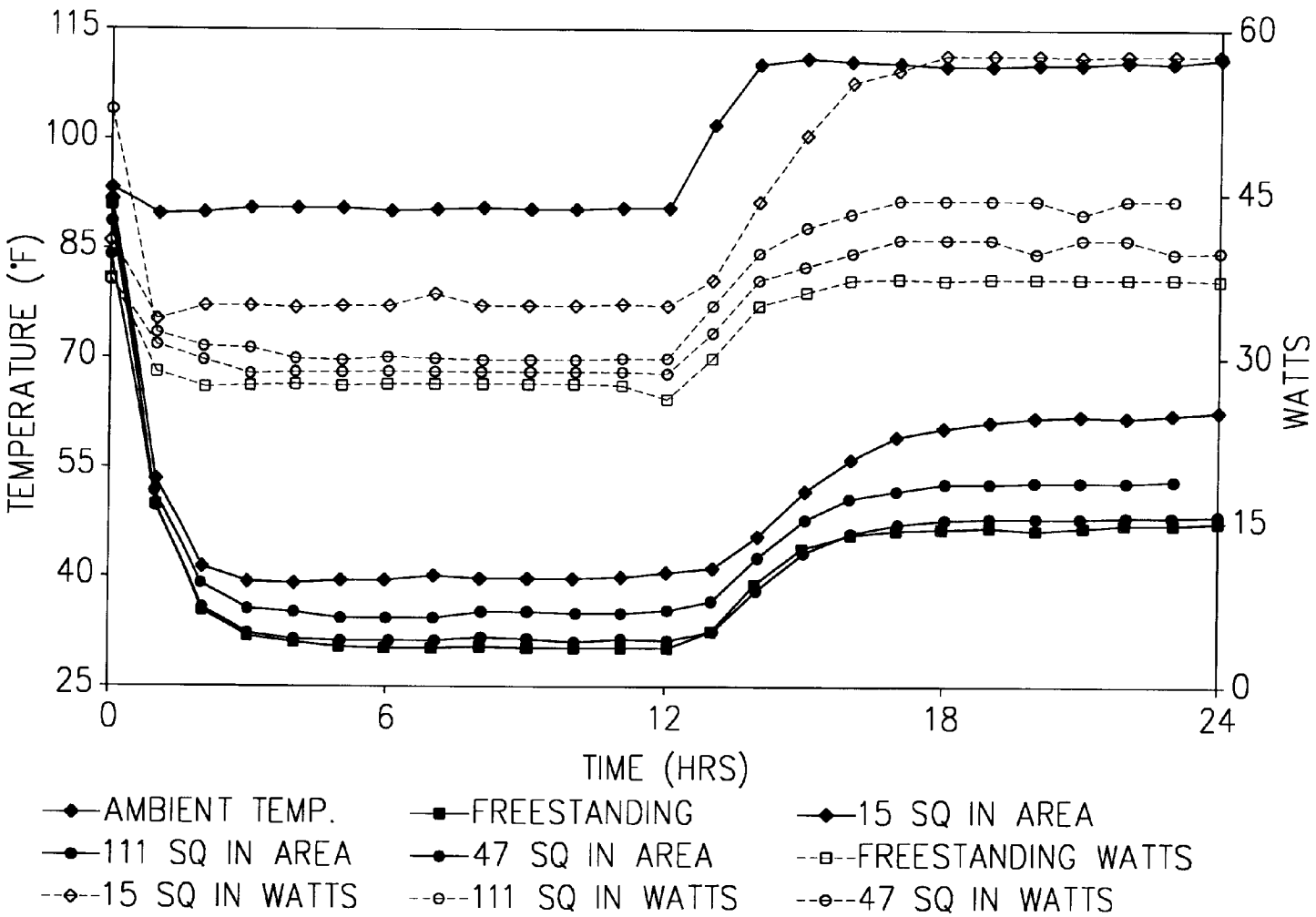
FIGS. 8 & 9 are performance charts showing the substantial temperature reduction using the present invention.

Referring now to FIG. 2, the installation template 12 is shown with refrigerator cabinet 10 placed into enclosure space 14. Ventilation openings 20 are positioned on the top flange 30 and the bottom flange 32 of installation template 12. In FIG. 2, for example, a Sanyo 1.7 cubic ft. refrigerator cabinet 10 is shown, but any of a number of such cabinets produced by a number of different manufactures may be used with the installation template 12 of the present invention. The Sanyo refrigerator cabinet is a block-shaped structure that measures 17.5 inches in height by 18.5 inches in width and 19.75 inches in depth. The manufacturer specification for ventilation for the Sanyo refrigerator requires that at least 47 square inches of ventilation space or more be available for airflow through the enclosure space, i.e., no forced air is provided in the enclosure (FIG. 8).

The path for the airflow 18 (FIG. 1) within the ventilation frame 16 may be initiated from a number of points. The following chart illustrates the possible inlet point and outlet point combinations that may be used with the present invention but is not all inclusive.

| Inlet | Outlet |
|---|---|
| Bottom | Top |
| Side | Top |

-continued

| Inlet | Outlet |
|---|---|
| Bottom | Side |
| Side | Side |

Figure 3:
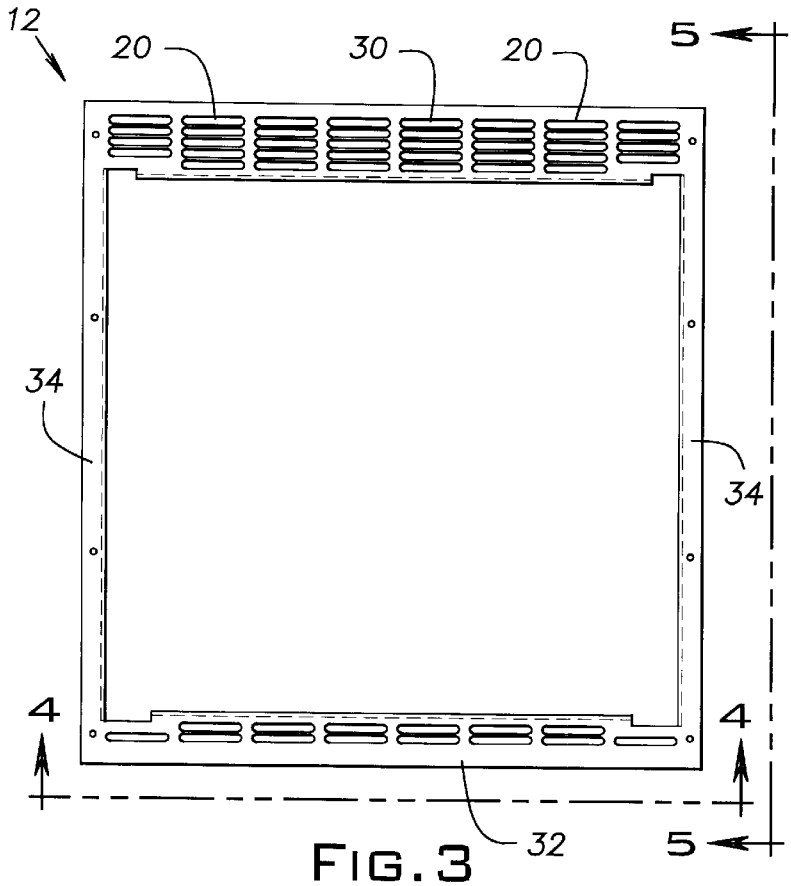
FIG. 3 is a front view of the installation template of this invention.
Figure 3A:
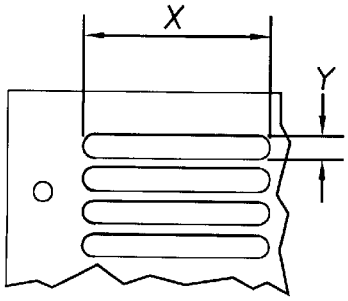
FIG. 3A is a partial view of a ventilation opening on the installation template of this invention.

Referring now to FIG. 3, the installation template 12 may include top flange 30, bottom flange 32 and side flanges 34, all of which may contain ventilation openings 20. As shown in FIG. 3A, each ventilation opening 20 forms a slot with a horizontal distance X and a vertical distance Y. For example, the typical horizontal distance X may be 2 inches and the vertical distance Y may be 0.20 inches for each of the ventilation openings 20. The ventilation openings may span across the top and bottom flanges in an equal number of rows and columns, or may vary as shown in FIG. 3. For example, the number of columns as shown in FIG. 3, could be eight with the number of rows maximizing at four or less, depending on the surface area available on the installation template 12

Figure 5:
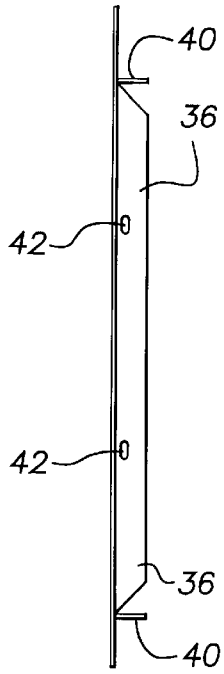
FIG. 5 is a side view of the installation template being illustrated by the line 5—5 in FIG. 3.
Figure 4:
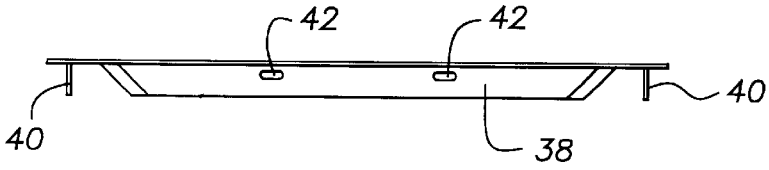
FIG. 4 is a side view of the installation template being illustrated by the line 4—4 in FIG. 3.

Referring now to FIGS. 4 & 5, the frame includes side support angles 36 and bottom support angles 38. The support angles 36, 38 may be constructed from 18 GA cold roll steel and extend for substantially the entire length of the top flange 30, the bottom flange 32 and the side flanges 34. A bent portion 40 is also provided on the support angles 36, 38 that provides a snug fit with the outside walls 22, 24, 26 of refrigerator cabinet 10. The support angles contain slots 42 that may be used to fasten the installation template 12 to the outside walls 22, 24, 26 of refrigerator cabinet 10 (not shown).

Figure 6:
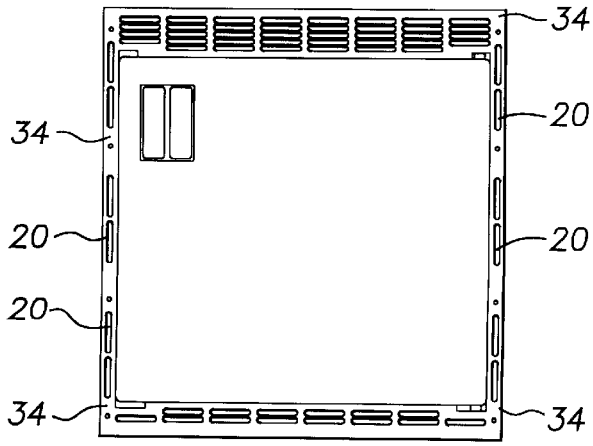
FIG. 6 is a front view of the RV refrigerator of this invention with the installation template including side openings.

Referring now to FIG. 6, the installation template 12 includes side flanges 34. The side flanges 34 may also contains ventilation openings 20. As shown in FIG. 3A, each ventilation opening 20 forms a slot with a horizontal distance X and a vertical distance Y (FIG. 3A). For example, the typical horizontal distance X may be 2 inches and the vertical distance Y may be 0.20 inches for each of the ventilation openings 20. The ventilation openings may span across the side flanges in an equal number of rows and columns, as shown in FIG. 6, depending on the surface area available.

Referring now to FIGS. 7A–D, the addition of an air movement device may reduce the amount of ventilation space required to cool the refrigerating apparatus. The air movement device may take many forms, one such form being an impeller fan. Other forms of air movement devices could include pressure blowers, air pumps, industrial exhausters and forced-draft centrifugals.

Figure 9:
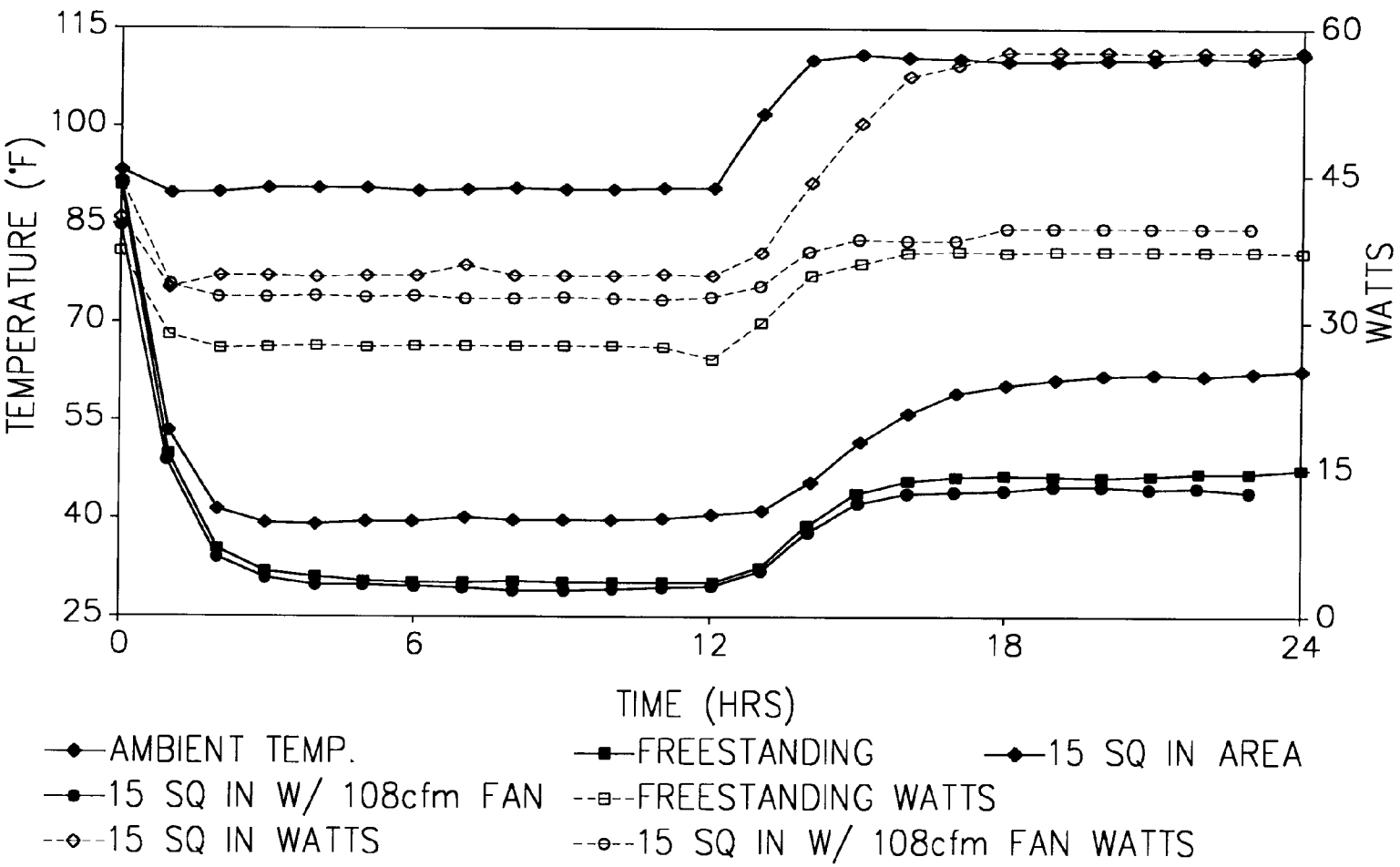

For example in FIGS. 7A–D, a fan 50 is used in the enclosure space 14 with installation template 12 to reduce the amount of ventilation space required for the refrigerator to an amount, such as 15 $in^2$ of ventilation space (FIG. 9). The fan 50 may be attached to a bracket 52 and the bracket 52 may be attached in a number of different configurations onto the refrigerator cabinet 10, as shown in FIGS. 7A–D.

Figure 7A:
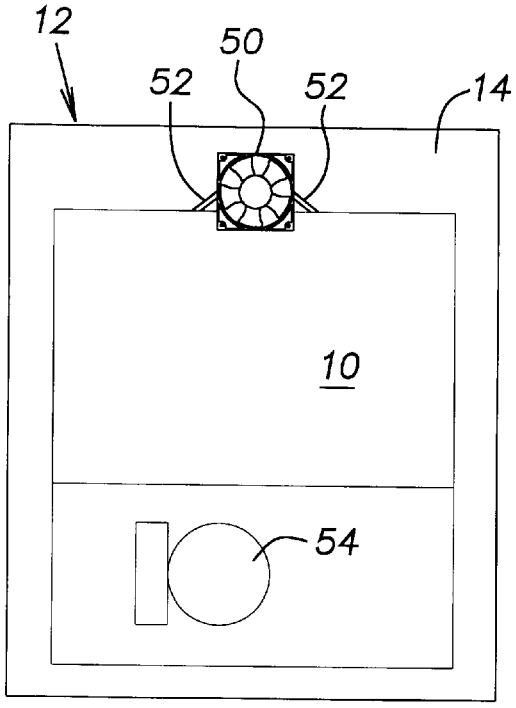
FIG. 7A is a side view of the RV refrigerator enclosure with a fan located in position 1.
Figure 7B:
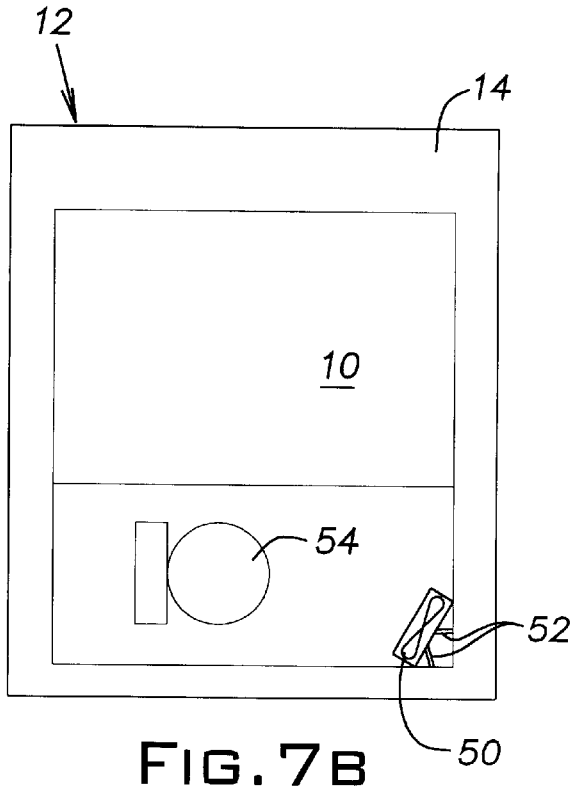
FIG. 7B is a side view of the RV refrigerator enclosure with a fan located in position 2.
Figure 7C:
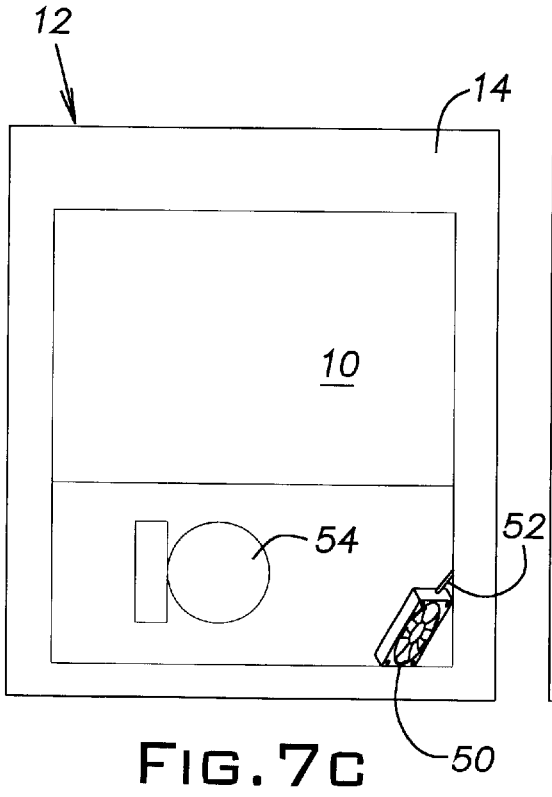
FIG. 7C is a side view of the RV refrigerator enclosure with a fan located in position 3.
Figure 7D:
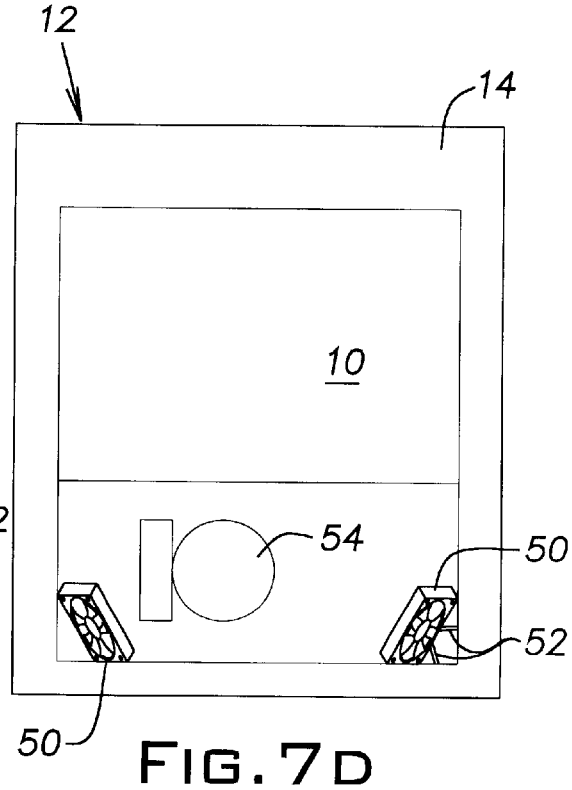
FIG. 7D is a side view of the RV refrigerator enclosure with a fan located in position 4.

In FIG. 7A, the fan is attached in location 1 which is at the top of the rear of the refrigerator blowing out the top of the installation template. In FIG. 7B, the fan is attached in location 2 on the right side of the compressor 54 compartment blowing up into enclosure space 14 and the fan is positioned at a 60 degree angle to the bottom right hand corner of the cabinet. In FIG. 7C, the fan is attached in location 3, on the right side of the compressor 54 compartment blowing up into enclosure space 14 and again at 60 degree angle but the fan is also tilted back at a 45 degree angle. In FIG. 7D, the fan is attached in location 4, on both sides of compressor 54 blowing up at a 60 degree angle and tilted back at a 45 degree angle. In the following table, the temperature (degree F.) and amps for each of the fan positions is indicated.

| Location | Temperature | Amps |
|---|---|---|
| 1 | 29.8 | 2.3 |
| 1 | 33.6 | 2.5 |
| 2 | 40.1 | 2.8 |
| 2 | 33.4 | 2.8 |
| 3 | 32.5 | 2.8 |
| 3 | 32.2 | 2.8 |
| 4 | 36.3 | 2.9 |

The performance charts in FIGS. 8 & 9 show the relationships of time vs temp and time vs watts comparisons for the present invention. FIG. 8 illustrates test results with no fan used with the present invention. In FIG. 9, a fan is used as the means for providing airflow through the installation template for providing the specified ventilation requirements for the refrigerator.

As is illustrated by the graphs in FIGS. 8 & 9, the temperature is greatly reduced in the enclosure space 14 when the installation template of the present invention is used when installing the refrigerator cabinet 10. A temperature range of 52 degree F. and below is acceptable, while a temperature range of 43 degree and below is preferred, for the enclosure space to permit reliable operation of the refrigerator. As may be seen from the graphs, a wattage of 45 watts is also found to be within the reliable operating range for the refrigerator. As illustrated by the charts, the enclosure space may be constructed at a minimum of 47 square inches or more to achieve the 52 degree or below temperature. These graphs were used to formulate the design criteria to shape the installation template 12 and its accompanying ventilation openings 20 and required temperature range.

Although the invention has been shown and described with respect to a certain embodiment, it is obvious that equivalent alterations and modifications will occur to others skilled in the art upon reading and understanding of the specification. The present invention includes all such equivalent alterations and modifications, and is limited only by the scope of the claims.

What is claimed is:

1. A refrigerator and vent assembly to be installed in a vehicle space comprising:

a refrigerator with refrigerating apparatus to be cooled disposed on a cabinet; and an installation template permanently installed on the cabinet as a ventilation frame, said installation template including top, bottom and side flanges, at least one of said flanges having ventilation openings, the dimensions of said flanges and openings being selected to ensure an air flow space according to specified ventilation requirements for the refrigerating apparatus.

2. The assembly according to claim 1 wherein said ventilation openings on said installation template consist of slots in the top and bottom flanges wherein said air flow enters from said bottom flange and exhausts from said top flange.

3. The assembly according to claim 1 wherein said ventilation openings on said installation template consist of slots in the side and top flanges wherein said air flow enters from said side flanges and exhausts from said top flange.

4. The assembly according to claim 1 wherein said ventilation openings on said installation template consist of slots in the bottom and side flanges wherein said air flow enters from said bottom flange and exhausts from said side flanges.

5. The assembly according to claim 1 wherein said ventilation openings on said installation template consist of slots in the side flanges wherein said air flow enters from one of said side flanges and exhausts from the other of said side flanges.

6. The improvement according to claim 1 wherein said flanges are made from 18 GA cold rolled steel.

7. The improvement according to claim 1 wherein said installation template includes the use of a retention bracket attached to the RV floor and installed before the installation template to position a rearwall of said refrigerator cabinet.

8. A refrigerator and vent assembly to be installed in a vehicle space comprising:

a refrigerator with refrigerator apparatus to be cooled disposed on a cabinet;

an installation template permanently installed on the cabinet as a ventilation frame, said installation template including top, bottom and side flanges, at least one of said flanges having ventilation openings, the dimensions of said flanges and openings being selected to ensure an air flow space according to the specified ventilation requirements for the refrigerating apparatus; and an air movement device for providing air flow through the space; said device providing the specified ventilation requirements for the refrigerating apparatus.

9. The assembly according to claim 8 wherein said ventilation openings on said installation template consist of slots in the top and bottom flanges wherein said air flow enters from said bottom flange and exhausts from said top flange.

10. The assembly according to claim 8 wherein said ventilation openings on said installation template consist of slots in the side and top flanges wherein said air flow enters from said side flanges and exhausts from said top flange.

11. The assembly according to claim 8 wherein said ventilation openings on said installation template consist of slots in the bottom and side flanges wherein said air flow enters from said bottom flange and exhausts from said side flanges.

12. The assembly according to claim 8 wherein said ventilation openings on said installation template consist of slots in the side flanges wherein said air flow enters from one of said side flanges and exhausts from the other of said side flanges.

13. The assembly according to claim 8 wherein air movement device for providing air flow through the installation template for ventilation around the refrigerator is free air space, said installation template requiring a ventilation area of between 45 and 50 $in^2$.

14. The assembly according to claim 8 wherein air movement device for providing air flow through the installation template for ventilation around the refrigerator is a fan, said installation template requiring ventilation area of between 10 and 20 $in^2$.

15. The assembly according to claim 14 wherein, said fan is attached to a bracket, said bracket being located on said refrigerator cabinet and within the enclosure space.

16. The improvement according to claim 8 wherein said flanges are made from 18 GA cold rolled steel.

17. The improvement according to claim 8 wherein said installation template includes the use of a retention bracket attached to the RV floor and installed before the installation template to position a rear wall of said refrigerator cabinet.

* * * * *